US009159484B2

(12) United States Patent
Tiemeijer

(10) Patent No.: US 9,159,484 B2
(45) Date of Patent: Oct. 13, 2015

(54) INTEGRATED CIRCUIT BASED TRANSFORMER

(71) Applicant: NXP B.V., Eindhoven (NL)

(72) Inventor: Lukas Frederik Tiemeijer, Eindhoven (NL)

(73) Assignee: NXP, B.V., Eindhoven (NL)

( * ) Notice: Subject to any disclaimer, the term of this patent is extended or adjusted under 35 U.S.C. 154(b) by 0 days.

(21) Appl. No.: 13/906,227

(22) Filed: May 30, 2013

(65) Prior Publication Data

US 2013/0321116 A1 Dec. 5, 2013

(30) Foreign Application Priority Data

Jun. 1, 2012 (EP) ..... 12170619

(51) Int. Cl.
*H01F 5/00* (2006.01)
*H01F 27/28* (2006.01)
*H01F 27/29* (2006.01)

(52) U.S. Cl.
CPC ..... *H01F 27/2804* (2013.01); *H01F 27/29* (2013.01); *H01F 2027/2809* (2013.01)

(58) Field of Classification Search
CPC ..... H01F 17/0006; H01F 27/2804; H01F 27/327; H01F 27/323; H01F 27/2828; H01F 41/127; H01F 41/04; H01F 41/122; H01F 41/041; H01F 19/04; H01F 29/025; H01F 29/02; H01F 29/04; H01F 2027/2809; H01F 21/02
USPC ..... 336/200, 232, 182, 205, 150
See application file for complete search history.

(56) References Cited

U.S. PATENT DOCUMENTS

| | | | | |
|---|---|---|---|---|
| 7,253,712 | B1 | 8/2007 | Papananos | |
| 2003/0137383 | A1 * | 7/2003 | Yang et al. | 336/200 |
| 2004/0217839 | A1 * | 11/2004 | Haaren et al. | 336/200 |
| 2006/0226510 | A1 | 10/2006 | Goren et al. | |

(Continued)

FOREIGN PATENT DOCUMENTS

| | | | |
|---|---|---|---|
| EP | 2 104 227 | A2 | 9/2009 |
| WO | 2004/055839 | A1 | 7/2004 |

(Continued)

OTHER PUBLICATIONS

Shi, J. et al. "Frequency-Thermal Characterization of On-Chip Transformers With Patterned Ground Shields", IEEE Transactions on Microwave Theory and Techniques, vol. 55, No. 1, 12 pgs (Jan. 2007).

(Continued)

*Primary Examiner* — Mangtin Lian

(57) ABSTRACT

An integrated circuit based transformer, comprising: a primary winding located in a winding layer, the primary winding having two primary terminals at a first side of the transformer; a secondary winding located in a winding layer, the secondary winding having two secondary terminals at a second side of the transformer, the first and second sides located at different sides of the transformer; and a reference bar located in a reference bar layer, the reference bar having a primary reference bar terminal at the first side of the transformer, and having a secondary reference bar terminal at the second side of the transformer. The reference bar is configured to provide a direct electrical connection between the first reference bar terminal and the second reference bar terminal.

16 Claims, 9 Drawing Sheets

(56) References Cited

U.S. PATENT DOCUMENTS

| | | | | |
|---|---|---|---|---|
| 2007/0120637 | A1* | 5/2007 | Ezzeddine | 336/200 |
| 2008/0094164 | A1 | 4/2008 | Hsu | |
| 2011/0241793 | A1* | 10/2011 | Frye et al. | 333/25 |

FOREIGN PATENT DOCUMENTS

| | | | |
|---|---|---|---|
| WO | 2009/101565 | A1 | 8/2009 |
| WO | 2009/130665 | A1 | 10/2009 |

OTHER PUBLICATIONS

Pfieffer, U. R. et al. "A 23-dBm 60-GHz Distributed Active Transformer in a Silicon Process Technology", IEEE Transactions on Microwave Theory and Techniques, vol. 55, No. 5, pp. 857-865 (May 2007).

Wang, C. et al. "A Physics-Based Equivalent-Circuit Model for On-Chip Symmetric Transformers With Accurate Substrate Modeling", IEEE Transactions on Microwave Theory and Techniques, vol. 57, No. 4, pp. 980-990 (Apr. 2009).

Rotella, F. M. et al. "Characterization, Design, Modeling, and Model Validation of Silicon on-Wafer M:N Balun Components Under Matched and UnMatched Conditions", IEEE Journal of Solid-State Circuits, vol. 41, No. 5, pp. 1201-1209 (May 2006).

El-Gharniti, O et al. "Modeling and Characterization of On-Chip Transformers for Silicon RFIC", IEEE Transactions on Microwave Theory and Techniques, vol. 55, No. 4, pp. 607-615 (Apr. 2007).

Extended European Search Report for Patent Appln. No. 12170619.6 (Nov. 7, 2012).

* cited by examiner

INTEGRATED CIRCUIT BASED TRANSFORMER

CROSS-REFERENCE TO RELATED APPLICATIONS

This application claims the priority under 35 U.S.C. §119 of European patent application no. 12170619.6, filed on Jun. 1, 2012, the contents of which are incorporated by reference herein.

The invention relates to transformers, in particular to integrated circuit based transformers Due to their ability to transform impedance levels and provide galvanic isolation, in some cases the use of a transformer is the only viable option to realise some desired circuit functionalities. When transformers process relatively high frequency signals, the transformers can be reduced in size, and ultimately they can become small enough to be integrated on-chip.

According a first aspect of the invention, there is provided an integrated circuit based transformer, comprising:

- a primary winding located in a winding layer, the primary winding having two primary terminals at a first side of the transformer;
- a secondary winding located in a winding layer, the secondary winding having two secondary terminals at a second side of the transformer, the first and second sides located at different sides of the transformer; and
- a reference bar located in a reference bar layer, the reference bar having a primary reference bar terminal at the first side of the transformer, and having a secondary reference bar terminal at the second side of the transformer, wherein the reference bar may be configured to provide a direct electrical connection between the first reference bar terminal and the second reference bar terminal.

Such an integrated circuit based transformer provides valuable space savings on-chip, as there is no need for a (reference) line to ground which is external (that is, located around the outside of) the primary and secondary windings. The reference bar may be located in the same region as the primary and secondary windings, but in a different layer to the primary and secondary windings, which saves on-chip space. Further, the reference bar may provide a common connection to ground for the primary and secondary windings.

The transformer may be configured such that the reference bar provides a common reference to ground for respective circuits associated with each of the primary and secondary windings. This may be advantageous in that separate connections are not required for the respective circuits.

The reference bar may be located such that it overlaps the primary and secondary windings. The footprint of the reference bar may overlap the footprint of the primary and secondary windings.

The first and second sides may be on opposite sides of the transformer.

The integrated circuit based transformer may comprise a substrate. The reference bar layer may be located between a winding layer and the substrate. This can be advantageous in examples where the top metal layers in an IC process have the largest thickness and thus the lowest resistivity. They are therefore the most suitable layers for transformer windings, which generally will carry the largest currents. The reference bar layer is likely to carry less current and is therefore can be suitable for a thinner lower metal layer, depending on the application.

The primary and secondary windings may be concentric.

The transformer may be mirror symmetric about an axis oriented along a longitudinal axis of the reference bar. This can allow the transformer behaviour to be modelled/described as a superposition of differential and common mode behaviour without the need to consider conversion from differential to common mode signals, (and possibly vice versa). The mirror symmetry essentially allows the transformer behaviour to be modelled more simply than a non-mirror symmetric transformer.

The reference bar may be centrally located; it may be located with a longitudinal axis along the mirror symmetry line of the transformer. This can allow for the transformer to be mirror symmetric. If the reference bar/line was to be located outside the transformer periphery (for example, looping around the primary and secondary windings), then there may not be the same mirror symmetry and the transformer may be more difficult to model and may provide less accurate modelling results than a mirror-symmetric transformer.

The primary winding may be in the same winding layer as the secondary winding. The primary winding and secondary winding may each have a different winding radius.

The primary winding may be in a primary winding layer and the secondary winding may be in a secondary winding layer separate to the primary winding layer. The primary winding and secondary winding may each have the same winding radius.

The integrated circuit based transformer may further comprise a ground shield located in a ground shield layer. The ground shield may comprise a series of strips of conducting material. The strips may be parallel. The strips may be oriented transverse/perpendicular to the longitudinal axis of the reference bar. The ground shield can reduce capacitive coupling effects between the primary and secondary windings and the substrate when the transformer is in operation, thereby improving transformer operation.

The ground shield may be connected to the reference bar. This connection may be a vertical connection such as a via, between the ground shield layer and the reference bar layer. In other examples, the ground shield layer and the reference bar layer may be the same layer, thus providing a direct connection between the ground shield and reference bar.

A first terminal of the primary winding may be connected to ground. A first terminal of the secondary winding may be connected to a different voltage. A second terminal of the primary winding may be connected to a signal voltage. The signal voltage typically refers to the voltage required to induce the desired radio frequency (RF) information carrying signal in the form of an alternating current (AC) in a signal frequency band in the primary winding of the transformer. A first terminal of the secondary winding may be connected to another voltage, for instance the supply voltage. The supply voltage typically refers to the voltage required to drive a direct current (DC) supply feeding attached circuitry through the transformer windings. The second terminal of the secondary winding may then provide a sum of the AC signal and DC supply voltages to the attached circuitry.

Alternate strips of the ground shield may be connected to the primary winding, and oppositely alternate strips of the ground shield may be connected to the secondary winding. This may provide the advantage that the transformer can readily be used as an isolation transformer having an integrated decoupling capacitor by a relatively straightforward connection system between the transformer windings and the ground shield strips.

The integrated circuit based transformer may further comprise a tap line located in a tap line layer. The tap line may have a tap line terminal located at a side of the transformer.

This side may be the first or second side of the transformer. The tap line may provide a connection between the tap line terminal and the primary or secondary winding partway along the winding, wherein the tap line has a longitudinal axis which may be positioned substantially along the longitudinal axis of the reference bar. Such a tap line may provide a connection point for connection to the primary and/or secondary windings. By locating the tap line substantially along the longitudinal axis of the reference bar, the mirror symmetry of the transformer can be retained, thereby allowing for more reliable and easier modelling of the transformer.

The tap line layer may comprise a primary tap line and a secondary tap line. In this case, the two tap lines may be positioned such that at least a portion of their longitudinal axes are skewed from the longitudinal axis of the reference bar. The primary tap line may be connected to the middle of the primary winding by a primary tap line via. The secondary tap line may be connected to the middle of the secondary winding by a secondary tap line via. This can allow the mid-points of the primary and secondary windings to be connected to their respective tap lines in the same tap line layer, while substantially maintaining the mirror symmetry of the transformer as a whole. This may be advantageous, as described above, for reliable modelling of the transformer behaviour.

The portions of the tap lines that provide terminals may be substantially parallel to the longitudinal axis of the reference bar. The portions of the tap lines at the extremities of the transformer may be substantially parallel to the longitudinal axis of the reference bar. In this way, two bends can be provided in each of the tap lines. The bends may have a 45 degree angle relative to the longitudinal axis of the reference bar, which may satisfy process design rules.

The transformer may comprise primary and secondary windings in a 1:1 ratio. The transformer may comprise a plurality of primary windings and/or a plurality of secondary windings.

A first terminal of the primary winding may be connected to the reference bar, which may be connected to ground. The secondary winding may be connected partway along its winding to the reference bar. Such a transformer may be used as a wide-band balun.

A first terminal of the primary winding may be unconnected. The secondary winding may be connected partway along its winding to the reference bar, which may provide a connection to ground. Such a transformer may be used as a narrow-band balun.

The substrate may be an insulator or a semiconductor. The substrate may have a resistivity of less than 10 $\Omega cm^{-1}$.

There may be provided an integrated circuit containing any transformer disclosed herein.

The invention will now be described by way of example, and with reference to the accompanying drawings in which:

FIG. 1 shows an electrical symbol representation of a four terminal transformer;

FIGS. 2*a* and 2*b* show transformers according to an embodiment of the invention, each with an integrated reference bar providing a low impedance ground return path;

Figure 5A:
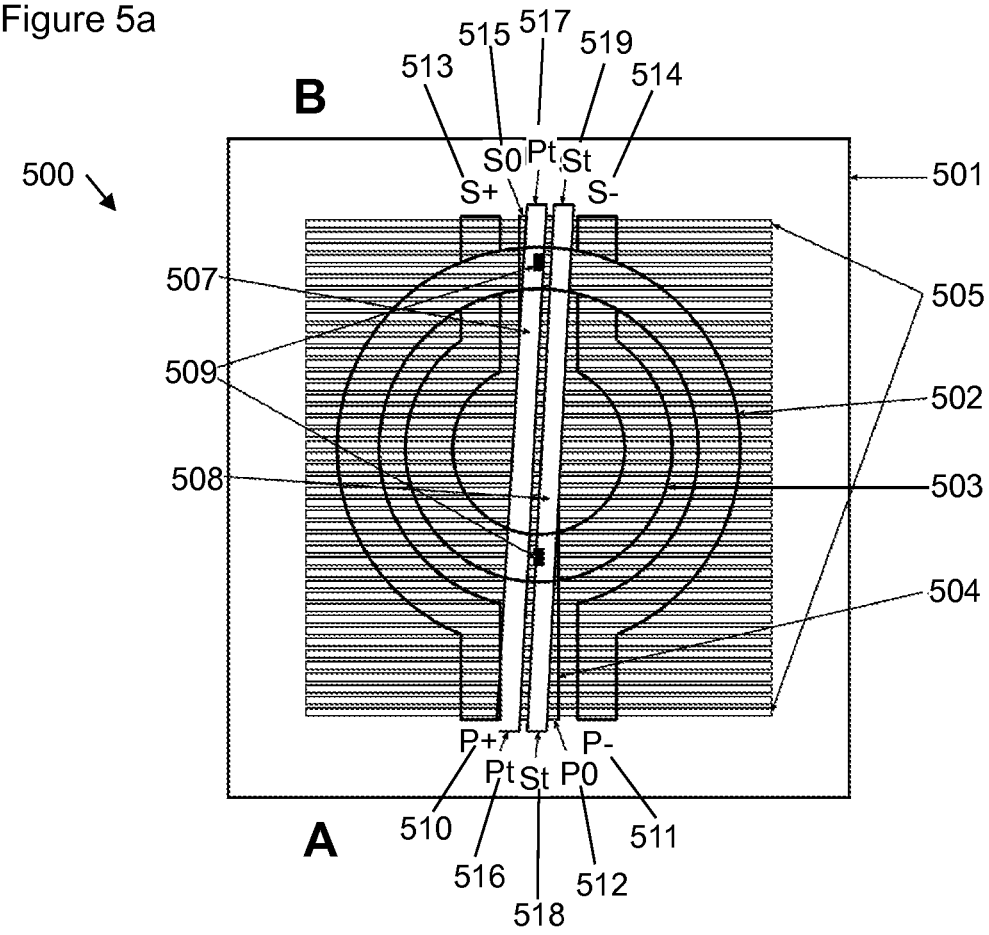
Figure 5B:
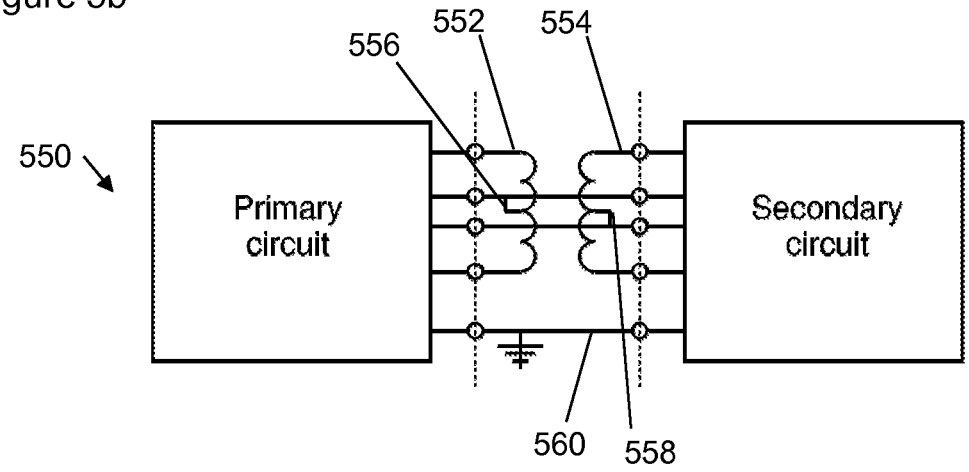

FIG. 5*a* shows a transformer according to an embodiment of the invention, with primary and secondary tap lines each connected to respective primary and secondary windings by vias;

FIG. 5*b* shows a circuit diagram including the transformer of FIG. 5*a;*

Figure 5C:
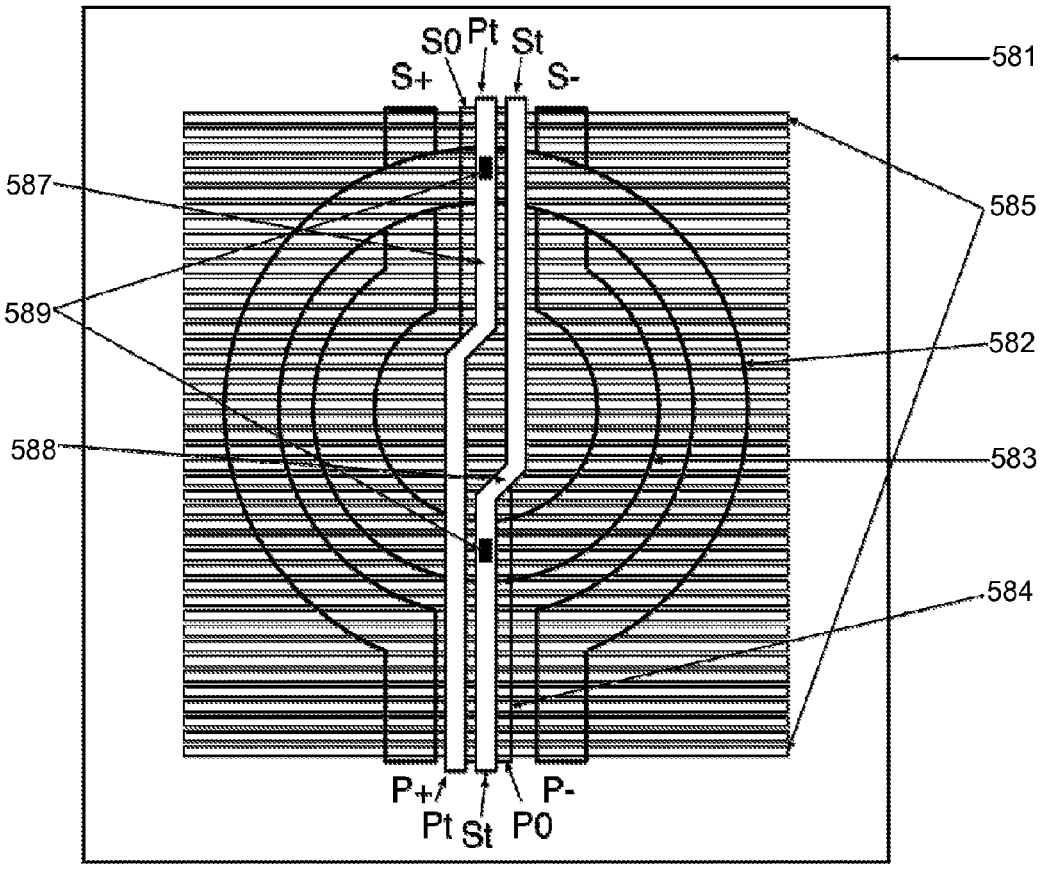
Figure 6A:
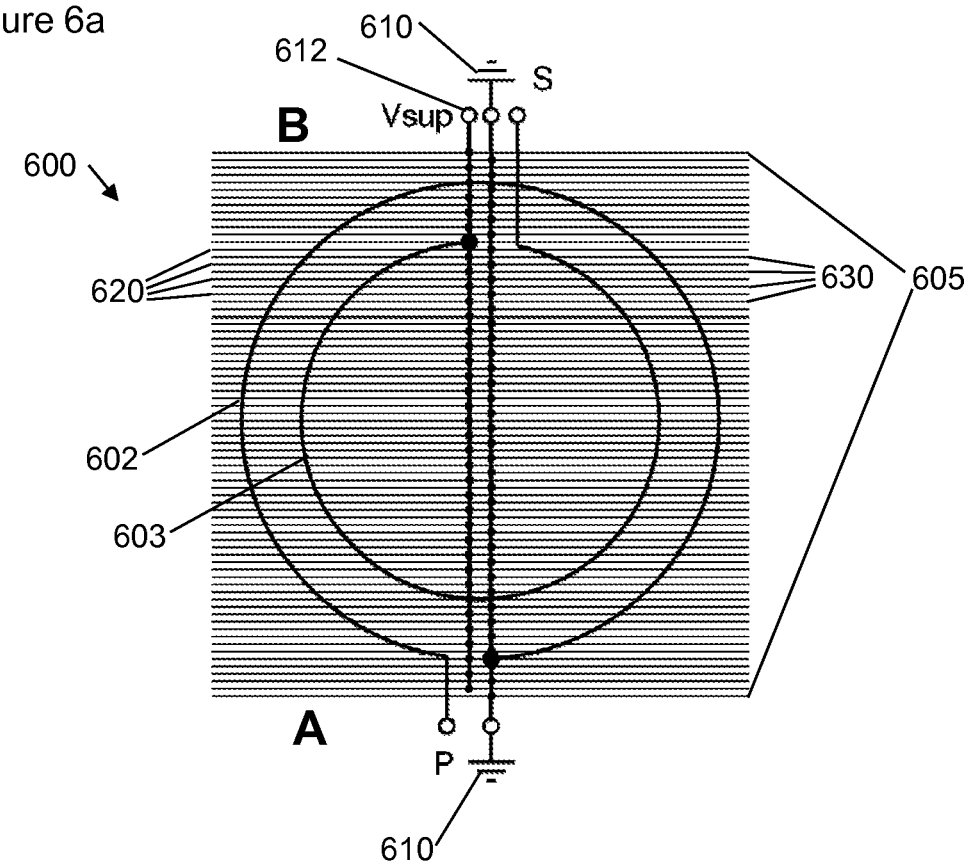
Figure 6B:
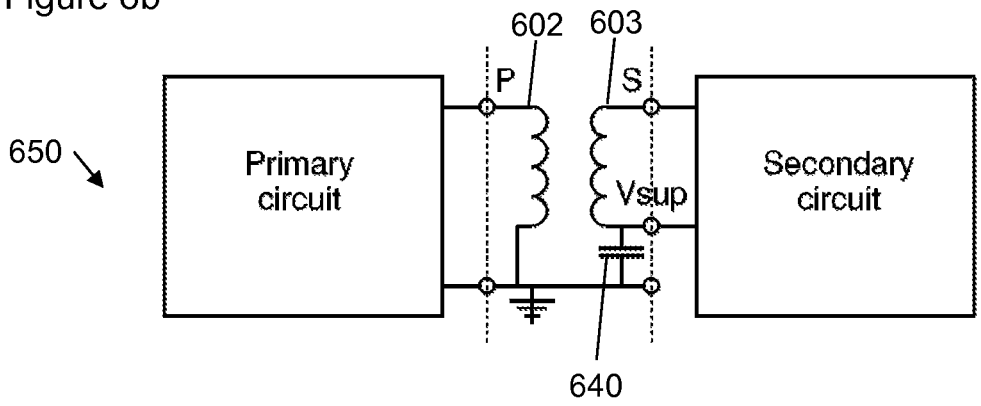

FIG. 5*c* shows a transformer according to another embodiment of the invention, with primary and secondary tap lines each connected to respective primary and secondary windings by vias;

FIG. 6*a* shows a transformer according to an embodiment of the invention, with connections between alternating bars of the ground shield and respective primary and secondary primary and secondary windings;

FIG. 6*b* shows a circuit diagram including the transformer of FIG. 6*a;*

Figure 7:
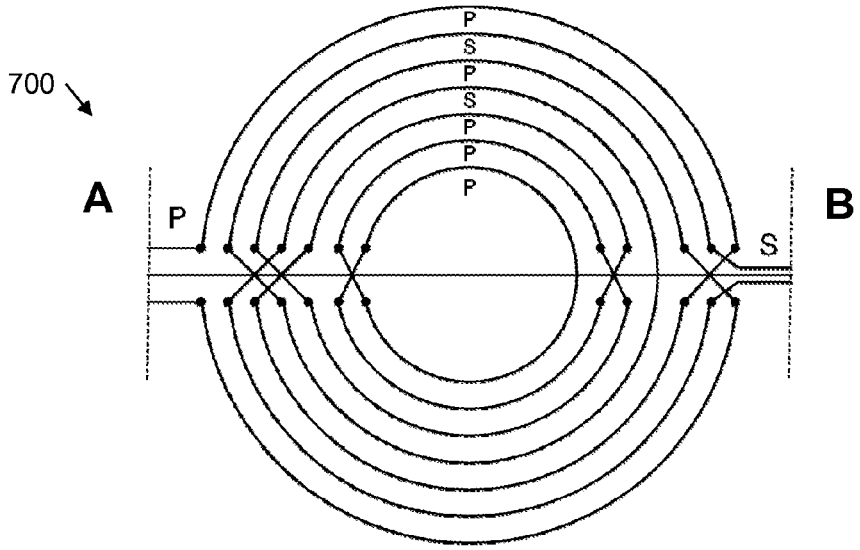
Figure 8A:
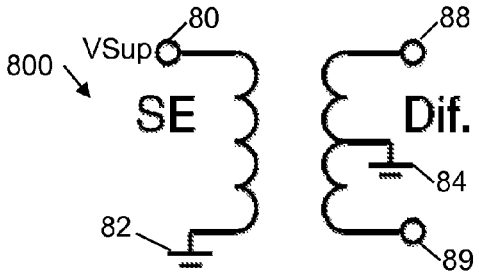
Figure 8B:
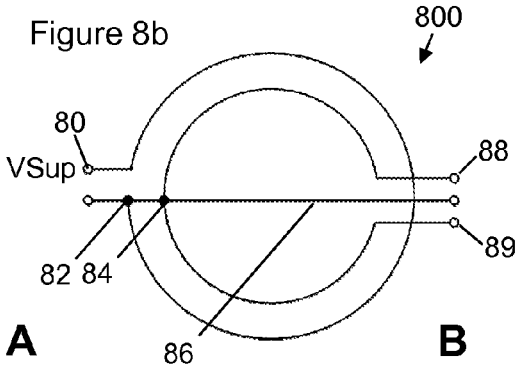
Figure 9A:
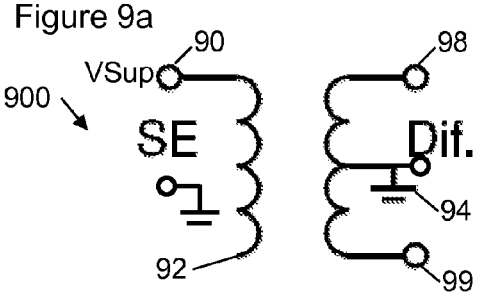
Figure 9B:
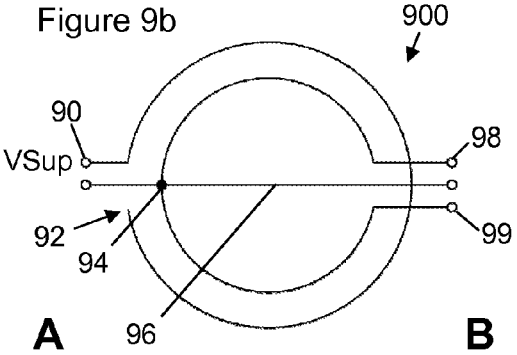
Figure 10:
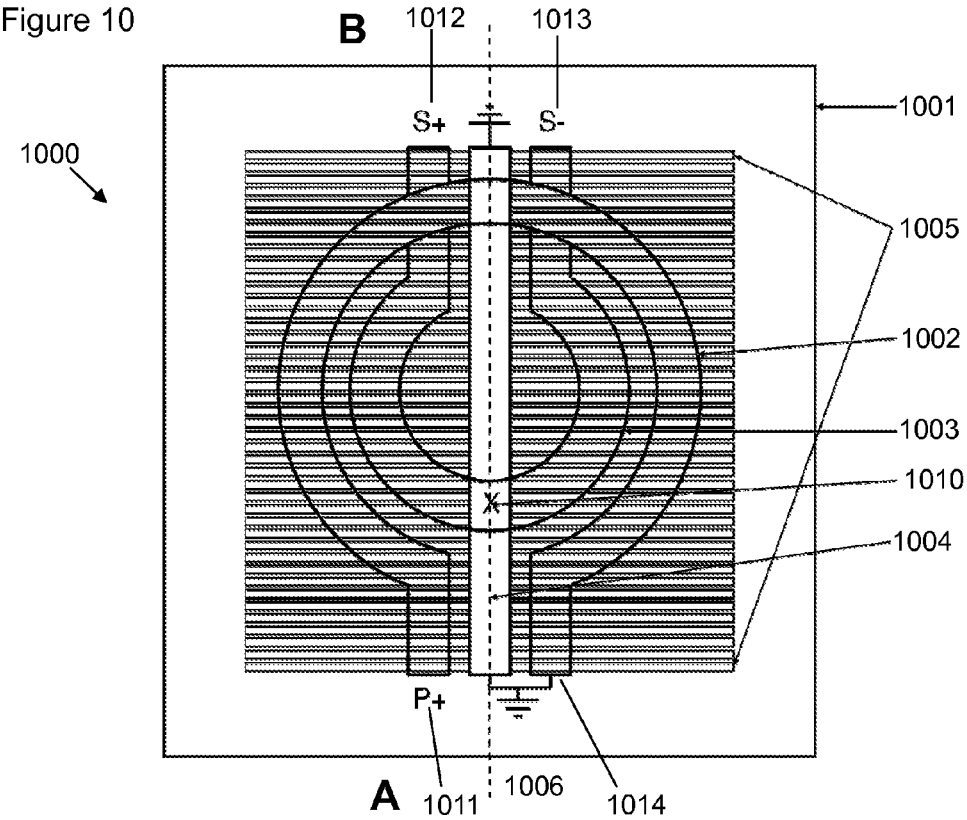
Figure 11A:
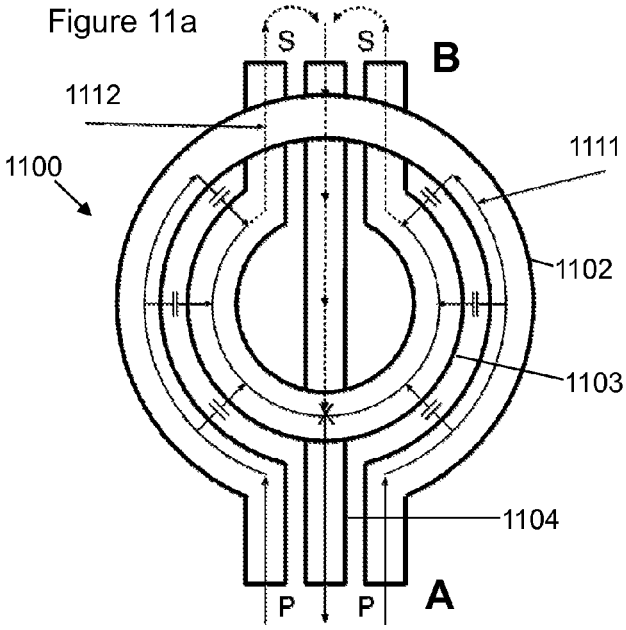
Figure 11B:
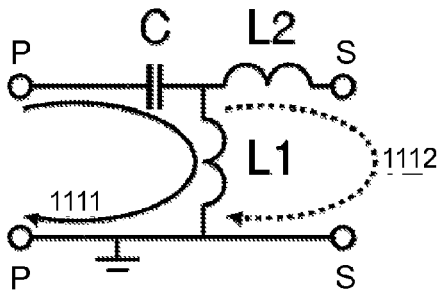

FIG. 7 shows a 5×2 transformer according to an embodiment of the invention, illustrating different ways to connect the respective primary and secondary windings;

FIGS. 8*a* and 8*b* show a transformer according to an embodiment of the invention, as an electrical symbol representation and a schematic representation;

FIGS. 9*a* and 9*b* show a transformer according to an embodiment of the invention, as an electrical symbol representation and a schematic representation;

FIG. 10 shows a transformer according to an embodiment of the invention, acting as a balun, with an integrated common mode return path;

FIG. 11*a* shows a transformer according to an embodiment of the invention, with an integrated common mode return path;

FIG. 11*b* shows a circuit diagram including the transformer of FIG. 11*a;*

Figure 12:
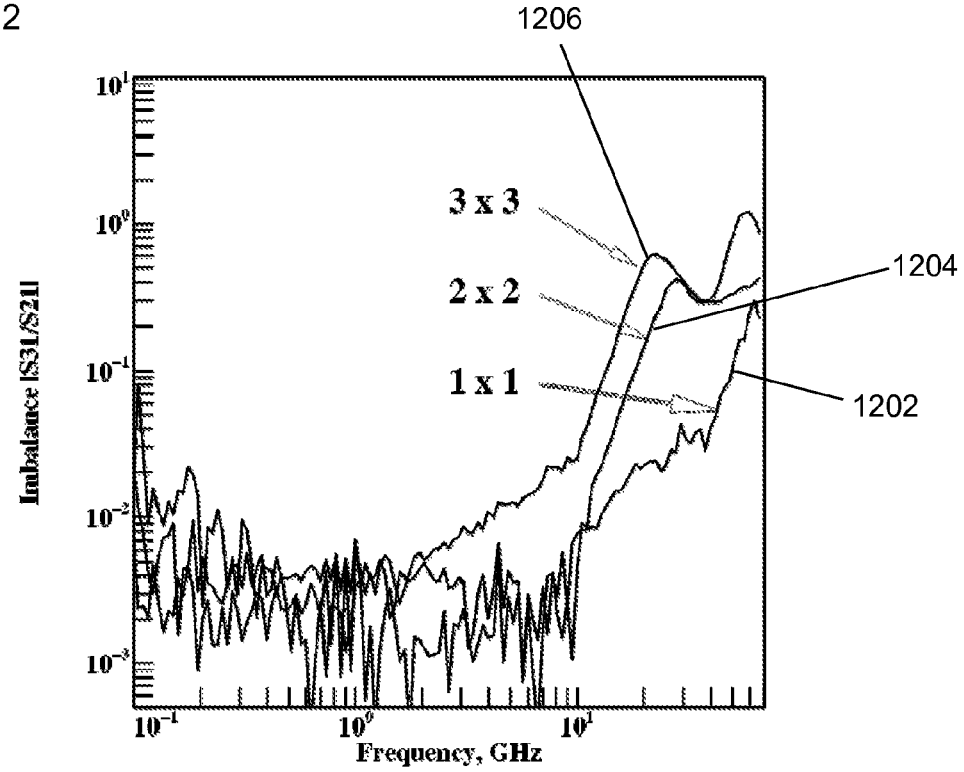
Figure 13:
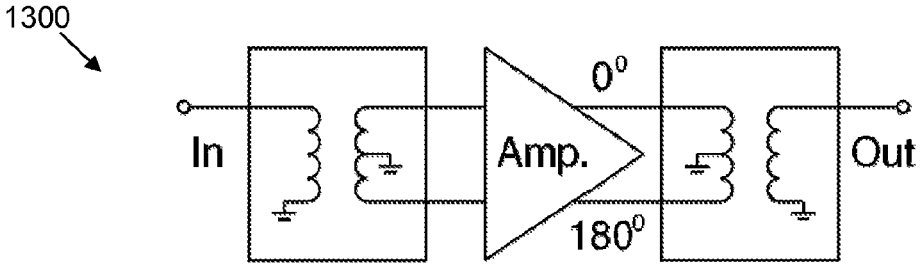

FIG. 12 shows a measured imbalance of three different example transformers; and FIG. 13 shows a circuit diagram representation of a differential amplifier including transformers according to an embodiment of the invention, acting as baluns.

Figure 14:
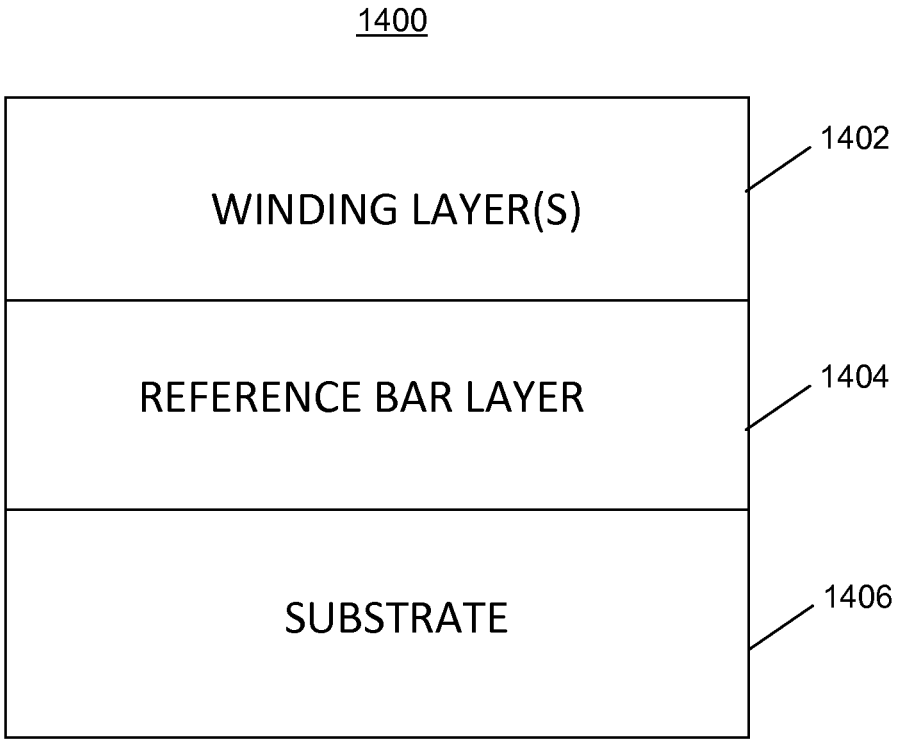

FIG. 14 shows a cross-sectional view of a transformer according to an embodiment of the invention.

Embodiments disclosed herein relate to an integrated circuit based transformer having a primary winding located in a winding layer. The primary winding has two primary terminals at a first side of the transformer. Also located in a winding layer on the substrate is a secondary winding having two secondary terminals at a second, different side of the transformer. The transformer also has a reference bar located in a reference bar layer. The reference bar has a primary reference bar terminal at the first side of the transformer, and has a secondary reference bar terminal at the second side of the transformer. The reference bar can provide a direct electrical connection between the first reference bar terminal and the second reference bar terminal. This reference bar advantageously provides a common connection to ground for circuits associated with the primary and secondary windings at the first and second sides of the transformer, and also, since it may be located within the confines of the transformer windings, saves valuable on-chip space compared with, for example, a transformer which has a reference line to ground located around the outside of the windings. Further advantages of the transformer disclosed herein will be apparent from the description of embodiments below.

At frequencies of a few 100 MHz and beyond, the performance of on-chip transformers may no longer benefit from the use of ferromagnetic cores. At even higher frequencies of a few GHz and beyond, good performance can be realised using the top-metal layers of integrated circuit (IC) processes to form the primary and secondary windings of these transformers. Typically only a few primary and secondary turns are needed.

There are two basic types of on-chip transformer. In a stacked transformer, the primary and secondary windings are fabricated in different metal layers. A high inductive coupling can be obtained by using the same inner and outer dimensions and minimising the vertical separation of the primary and secondary windings. In a lateral transformer, the primary and secondary windings are fabricated in the same metal layer(s). A high inductive coupling can be obtained in a lateral transformer by laterally alternating the primary and secondary turns and minimising their lateral separation.

Integrating a transformer onto silicon in an integrated circuit (IC) process can raise two issues which should be addressed. Firstly, when the transformer is made, even if it is in the top-metal layers of the IC process, the distance from the transformer windings to the conductive silicon substrate will be relatively small compared to the typical winding diameters required for good performance of the transformer. Therefore, not only the intrinsic transformer behaviour, but also the capacitive coupling to the substrate should be characterised and accounted for during circuit simulation. Secondly, when the transformer is used at frequencies where only one or a few turns of interconnect are sufficient to obtain desirable self and mutual inductances, the self and mutual inductances of the interconnect wires connecting the transformer to the other circuit elements cannot be neglected in a circuit simulation. Moreover, in order to simulate how such a transformer may behave in an actual RF circuit, the parasitic inductances and capacitances of the transformer need to be characterised with relatively high accuracy and included in a transformer simulation model. Typical tolerated errors for these parasitic inductances and capacitances are in the few percent range.

In integrated circuit design, it may be possible to model a circuit using design tools for circuit simulation. It is important to be able to model transformers in circuits accurately, including factors such as inductance and resistance, and including parasitic values. It is useful to know where parasitic values arise in a circuit, for example to understand how to minimise them.

Figure 1:
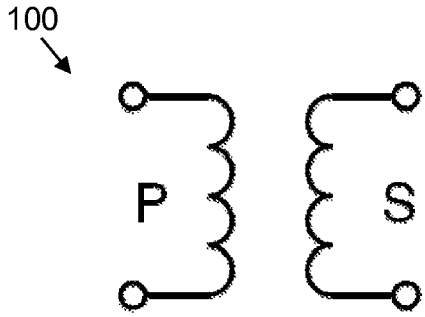

FIG. 1 shows a four terminal transformer 100, with a primary winding P and a secondary winding S.

Figure 2A:
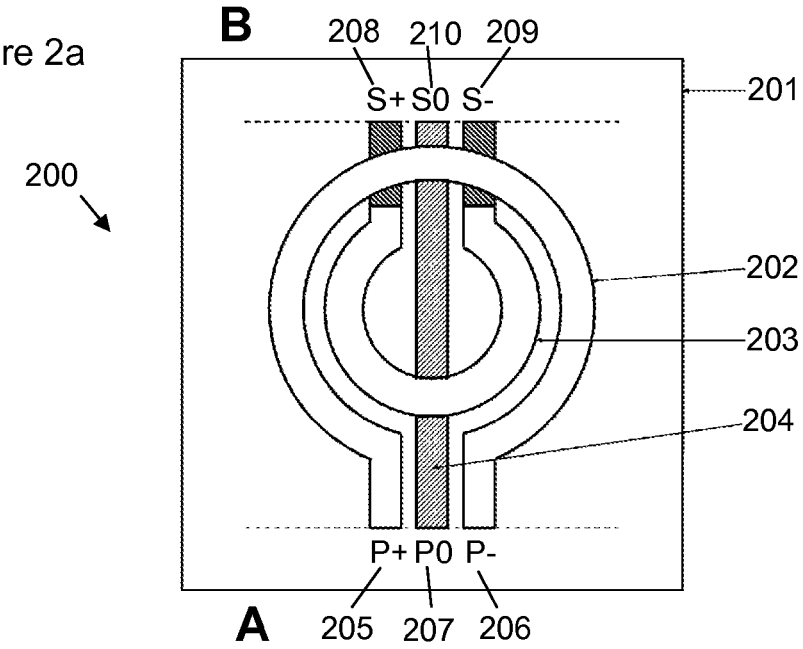
Figure 2B:
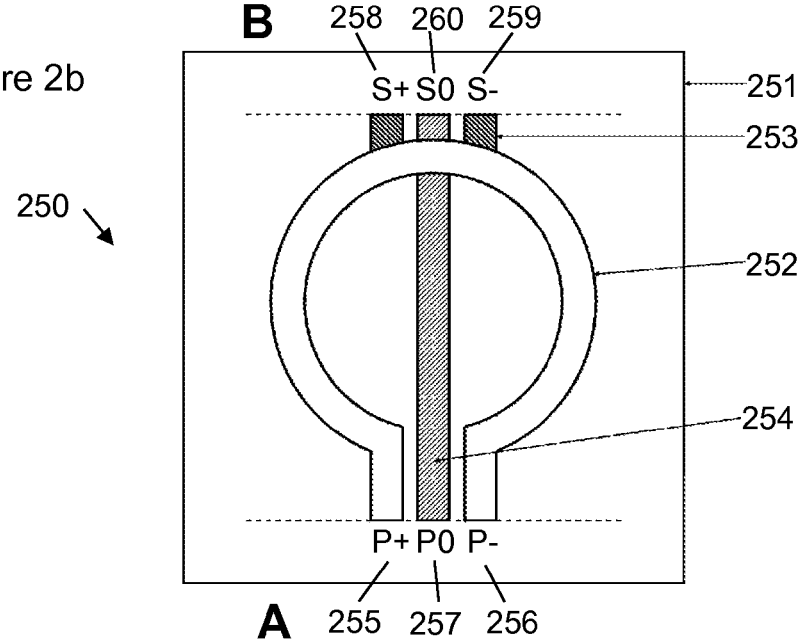

FIGS. 2*a* and 2*b* each show a transformer 200, 250 according to embodiments of the invention, each transformer having an integrated low impedance ground return path provided by a reference bar 204, 254 as discussed below. The transformer 200, 250 is fabricated on an isolating or a semiconducting substrate 201, 251. When the substrate 201, 251 is a silicon substrate, it should have a high resistivity such that the magnetic field of the transformer 200, 250 in operation cannot induce significant currents in this substrate 201, 251. A substrate resistivity of 10 $\Omega cm^{-1}$ is usually sufficient. The boundary of the transformer 200, 250 (which may be modelled using circuit design tools) is shown by the dashed lines at sides A and B of the transformer 200, 250.

The transformer 200, 250 has at least one primary winding 202, 252 and at least one secondary winding 203, 253. The primary winding 220, 252 and secondary winding 203, 253 are concentric. The transformer 200, 250 is also mirror symmetric about an axis oriented along the longitudinal axis of the reference bar 204, 254.

FIG. 2*a* shows both the primary winding 202 and the secondary winding 203, made in a relatively thick top metal layer. The primary winding 202, and secondary winding 203, in FIG. 2*a* have different radii. In this figure, the primary winding 202 and secondary winding 203 are in the same winding layer. The terminals S+ 208 and S− 209 at the ends of the secondary winding 203 should pass into a different layer to avoid contact with the primary winding 202.

FIG. 2*b* shows the secondary winding 253 in a different layer to the primary winding 252. The primary winding 252 and secondary winding 253 have the same radius in FIG. 2*b*, made possible by the two windings 252, 253 being in different winding layers.

The following discussion applies to both FIGS. 2*a* and 2*b*.

The primary winding 202, 252 has two primary terminals P+ 205 255, P− 206, 256 at a first side A of the transformer. The secondary winding 203, 253 has two secondary terminals S+ 208, 258, S− 209, 259 at a second side B of the transformer. The primary terminals P+ 205, 255 P− 206, 256 and the secondary terminals S+ 208, 258 S− 209, 259 allow for external circuitry to be connected to the transformer. The first A and second B sides are located at different sides of the transformer. The reference bar 204, 254 has a primary reference bar terminal P0 207, 257 at the first side A of the transformer, and has a secondary reference bar terminal S0 210, 260 at the second side B of the transformer. The reference bar provides a direct electrical connection between the first reference bar terminal P0 207, 257 and the second reference bar terminal S0 210, 260. In this example, the first A and second B sides are on opposite sides of the transformer 200, 250.

Typically the connection from outside the transformer 200, 250 to the terminals of the secondary winding 203, 253 is made in a lower metal layer (that is, a layer closer to the substrate, rather than an upper layer further from the substrate).

The reference bar 204, 254 provides a low impedance ground return path and is made in a second or a third layer (a reference bar layer), which is typically close to the substrate 201, 251; that is, in one of the first few layers next to the substrate, rather than an upper layer further from the substrate. The reference bar layer may be located between the lowest winding layer and the substrate 201, 251.

The reference bar 204, 254 is located such that it overlaps the primary 202, 252 and secondary 203, 253 windings. The width of the reference bar 204, 254 is small enough to mitigate disturbance of the proper operation of the transformer by eddy current loops in the reference bar 204, 254, and wide enough that the resistance of the reference bar 204, 254 remains small. Typically the width of the reference bar 204, 254 will be approximately the same as the width of the transformer windings 202, 252, 203, 253 or slightly smaller. In some examples, this width may be about 10 μm. The reference bar 204, 254 may be used to provide a common connection to ground at both sides of the transformer 200, 250.

The location of the reference bar as shown in FIGS. 2*a* and 2*b* is within the confines of the transformer, thereby removing the need for a connection to ground which would otherwise be located in a separate circuit path around the outside of the transformer. Such an internal reference bar (a reference bar which is located essentially within the confines/periphery of the transformer) saves valuable on-chip space, by not requiring more space outside the confines of the transformer to provide a common ground connection. Further, a transformer having an internal reference bar may be more accurately and easily modelled, since there is no need to consider the more complex behaviour of an external reference path outside the confines of the windings.

By having a ground line/reference bar 204, 254 running along the central mirror symmetric axis of the transformer as shown in FIGS. 2*a* and 2*b* for example, minimal, or relatively low, inductive coupling of signals between the reference bar and windings can result. In contrast, a ground line located at the side (away from a symmetry axis) of the transformer may cause inductive coupling between the ground line and the primary and/or secondary windings 202, 252, 203, 253 thereby degrading the performance of the transformer. In modelling an outside ground line of a transformer, often the line is looped at a distance away from the primary and secondary windings to prevent such inductive coupling; however, increasing the distance between the outside ground line and the windings can be disadvantageous as it can further increase the valuable space required on the chip for the transformer. For example, the chip area required to include a transformer with an outside ground line having acceptably low inductive coupling with the windings may typically be two to three times greater than for a transformer according to an embodiment of the invention having an internal ground line/reference bar 204, 254.

Figure 3:
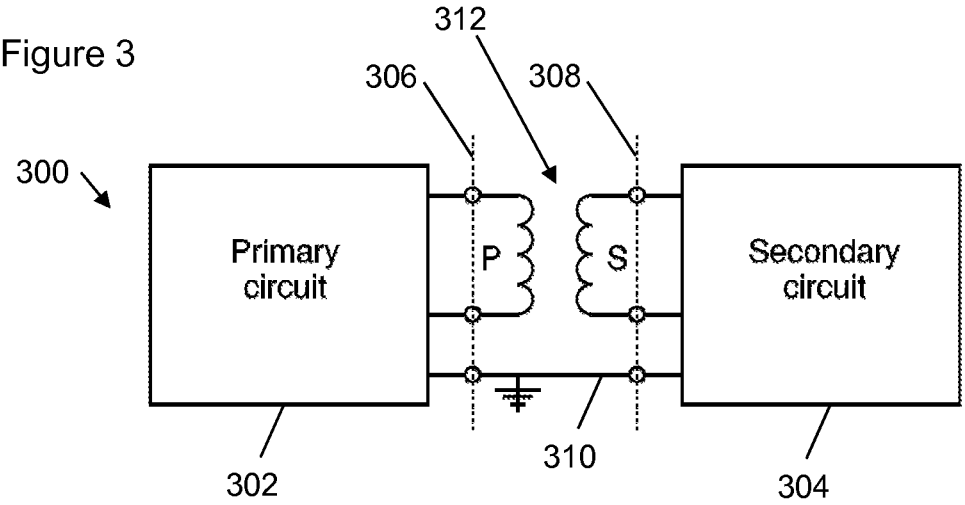
FIG. 3 shows a circuit diagram including the transformer of FIG. 2*a* or 2*b;*

FIG. 3 shows a circuit diagram representation 300 for circuit simulation of a transformer 312 according to an embodiment of the invention, the transformer 312 located between a primary circuit 302 and a secondary circuit 304.

The circuit 300 of FIG. 3 includes a transformer 312, which can be implemented using the transformer of FIG. 2*a* or 2*b*. The primary winding P can be the primary winding 202, 252 in FIGS. 2*a* and 2*b*. The secondary winding S in FIG. 3 can be the secondary winding 203, 253 in FIGS. 2*a* and 2*b*. The internal ground return line 310 in FIG. 3 can be provided by the reference bar 204, 254 in FIGS. 2*a* and 2*b* and can provide a common reference point/plane at both sides of the transformer. The transformer terminal voltages and currents are provided at the well defined dashed impedance reference points 306, 308 and measured against the internal ground return line 310. This internal ground return line 310 can be at the same potential as the (silicon) substrate, but can have a better current carrying capability.

If there was no internal ground return line 310, then to provide a common reference to ground, a ground line would need to be routed around the outside of the primary and secondary windings of the transformer 312. A ground line can be very important to provide a reference to ground (a voltage reference) for circuits 302, 304 coupled to the primary and secondary windings. By including the (ground) reference bar 310 within the same area as the primary and secondary windings 202, 252, 203, 253 the transformer may be modelled using circuit design tools and the transformer may be modelled correctly. If a circuit designer were required to include a reference to ground which was located outside the area of the primary and secondary windings then it is likely that the contribution this outside/external ground line would make the operation of the transformer more difficult to model or even unpredictable.

By improving the accuracy with which circuits including an IC-based transformer can be modelled (by the presence of an internal ground reference line), the behaviour of such transformers may be better accounted for in the model. This leads to improved performance of a physically realised transformer based on the improved model when the transformer(s) is/are implemented on a chip.

Figure 4:
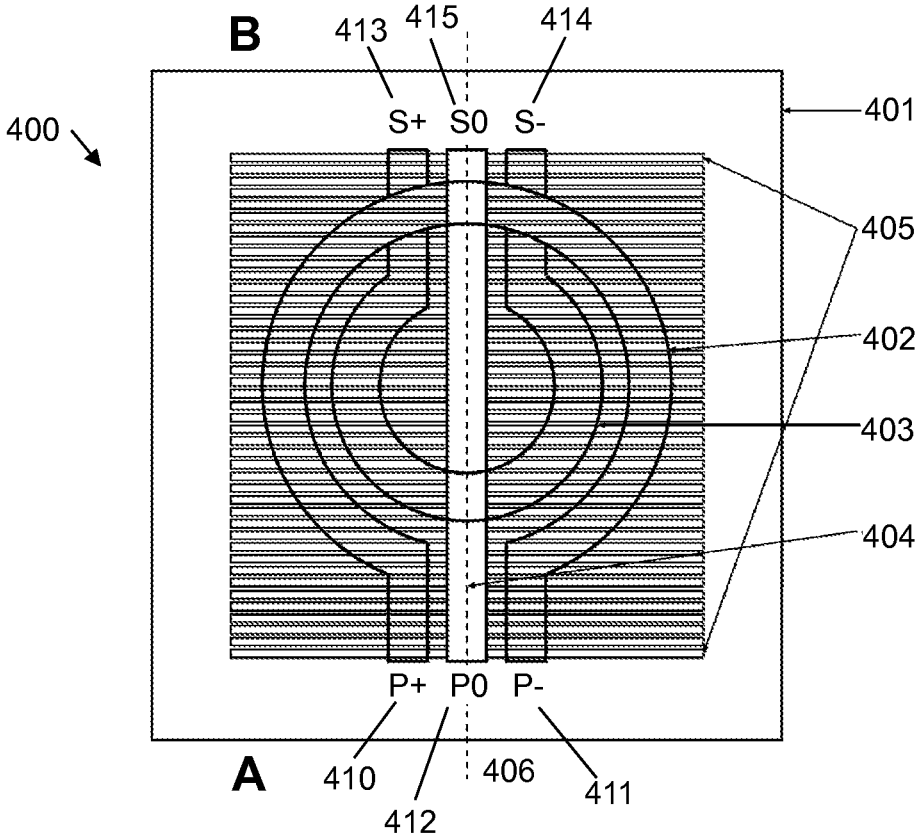
FIG. 4 shows a mirror-symmetrical transformer according to an embodiment of the invention, having a ground shield.

FIG. 4 shows an example of a mirror symmetrical transformer 400 with a ground shield 405 according to an embodiment of the invention. The transformer 400 in the example of FIG. 4 is mirror symmetric about an axis 406 oriented along the longitudinal axis of the reference bar 404. The primary winding 402 has two primary terminals P+ 410, P− 411 at a first side A of the transformer. The secondary winding 403 has two secondary terminals S+ 413, S− 414 at a second side B of the transformer. The first A and second B sides are located at different sides of the transformer. The reference bar 404 has a primary reference bar terminal P0 412 at the first side A of the transformer, and has a secondary reference bar terminal S0 415 at the second side B of the transformer. In this example, the first A and second B sides are on opposite sides of the transformer 400.

If the layout is made symmetric about a mirror symmetry axis 406 as shown, there may be the advantage that the transformer 400 behaviour can be described as a superposition of differential and common mode behaviour, without the need to consider conversion from differential into common mode signals.

Further, a mirror symmetric transformer 400 is likely to benefit from the inclusion of a ground shield 405 such as a patterned ground shield 405 as shown in FIG. 4. The term "patterned" may refer to the ground shield 405 comprising a series of non-contiguous parallel electrically conductive bars, in this example having orientations transverse to the mirror symmetry plane 406. That is, the electrically conductive bars may be close to each other, but not touching. Such a ground shield 405 may reduce capacitive coupling to the substrate when the transformer 400 is in operation. Capacitive coupling in this way could result in signal power loss due to the unfavourable substrate conductivity. Although the transverse orientation is considered the most effective, it will be appreciated that other orientations of the ground shield bars may be used whilst still obtaining some of the advantages that the ground shield provides.

In fabricating an inductor or transformer in an IC process, the distance between the windings and the substrate is typically a few microns. In certain processes, for example III-V processes such as those using GaAs, the substrate is isolated. If, as in other IC processes, the substrate is Si then the substrate is (semi)conductive. The magnetic field present when the inductor/transformer is in operation induces current loops in the (semi)conductive substrate, just as a current is induced in the secondary windings of the transformer. In systems where the distance between the windings and the substrate is about a few microns, then capacitive coupling with the substrate can take place, which induces unwanted charges and currents in the (non-perfect isolating) substrate. An (induced) capacitance between the two terminals of the transformer windings can degrade the transformer performance and give rise to parasitic losses due to the current induced. Such parasitic losses from capacitive coupling may be mitigated by using a high substrate resistivity, or an isolating substrate; but in IC processes this can be difficult to do.

The above problems can be addressed by embodiments of the present invention by including a metal plate in a lower metal layer between the substrate layer and the winding layers. This lower metal layer can be the ground shield layer 405 of FIG. 4. In this way, any induced capacitive coupling will be induced between the windings and the metal plate, rather than between the windings and the substrate. If the metal plate/ground shield 405 is included and located just below the winding layer(s), then less power is dissipated from the transformer into the substrate through capacitive coupling, thereby reducing parasitic losses, and increasing the performance and Q-factor of the transformer.

If a solid non-patterned metal plate is used as a ground shield, then currents induced in the metal plate can flow in circular loops in the plate and can degrade the performance of the transformer. This may be considered a disadvantage because such circular loops of current can cause parasitic losses in the system, and must be accounted for in a model of the transformer if a high accuracy of the model is to be achieved. This is not straightforward. Moreover these induced currents flow at the expense of the currents in the secondary winding of the transformer. By patterning a ground shield 405, such as by forming the ground shield from a series of non-contiguous conductive metal strips as shown in FIG. 4, then the induction of circular loop currents in the plate is greatly reduced and performance of the transformer can be enhanced. Such strips in a ground shield may be fabricated in an IC process with a small width, for example of the order of one micron.

To handle common mode signals, the electrically conductive bars of the ground shield 405 may be connected to the low impedance ground return path 404. The ground shield may be fabricated in a ground shield layer. This ground shield layer may in some examples be the same layer as the reference bar layer comprising the reference bar 404 in order to provide a direct connection at the intersections between the ground shield bars 405 and the reference bar 404.

FIGS. 5*a* and 5*b* show an example transformer 500 according to an embodiment of the invention, with a primary tap line 507 and a secondary tap line 508. The primary tap line 507 is shown connected approximately half way along the length of the primary winding 502 to the primary winding 502 by a primary tap line via 509. Also a secondary tap line 508 is shown connected approximately half way along the length of the secondary winding 503 to the secondary winding 503 by a secondary tap line via 509. A via is a through-connection or vertical connection between different layers in an electronic circuit or integrated circuit. The primary and secondary tap lines 507, 508 are realised in this example in an intermediate metal layer (a tap line layer), located between the substrate and the winding layer(s), for example.

In the case where both the primary and secondary windings 502, 503 should be galvanically isolated from each other, and both primary and secondary windings 502, 503 need to be connected to a respective primary or secondary tap line 507, 508 by connection through a respective primary or secondary tap line via 509, it may be difficult to completely preserve the mirror symmetry about the longitudinal axis 506 of the reference bar 504. Embodiments of the invention such as that shown in FIG. 5*a* can use skewed tap lines. Alternatively, small bends in the tap lines may be provided if the desired line skew is not allowed. Such an example is shown in FIG. 5*c* and is discussed further below. The embodiments of FIGS. 5*a* and 5*c* cause a deviation from full mirror symmetry yet can still provide acceptable behaviour of the transformer. Further details are provided below.

The primary tap line 507 in FIG. 5*a* has two primary tap line terminals: a first primary tap line terminal Pt 516 located at a first side A of the transformer 500, and a second primary tap line terminal Pt 517 located at a second side B of the transformer 500. The primary tap line 507 provides a connection between each primary tap line terminal Pt 516, 517 and the primary winding 502 partway along the winding 502. The primary tap line 507 has a longitudinal axis positioned substantially along, but slightly skewed from, the longitudinal axis 506 of the reference bar 504.

Similarly, the secondary tap line 508 in FIG. 5*a* has two secondary tap line terminals: a first secondary tap line terminal St 518 located at a first side A of the transformer 500, and a second secondary tap line terminal St 519 located at a second side B of the transformer 500. The secondary tap line 508 provides a connection between each secondary tap line terminal St 518, 519 and the secondary winding 503 partway along the winding 503. The secondary tap line 507 has a longitudinal axis positioned substantially along, but slightly skewed from, the longitudinal axis 506 of the reference bar 504.

The first primary tap line terminal Pt 516 and the first secondary tap line terminal St 518 are on the same side of the transformer 500 as the primary winding terminals P+ 510 and P− 511 and the reference bar terminal P0 512. The second primary tap line terminal Pt 517 and the second secondary tap line terminal St 519 are on the same side of the transformer 500 as the secondary winding terminals S+ 513 and S− 514 and the reference bar terminal S0 515. In this way, the tap lines can be conveniently connected to circuits associated with either the primary or secondary windings.

In other examples, only a primary tap line, or only a secondary tap line, may be included.

In this example of FIG. 5*a* with a primary and a secondary tap line 507, 508, it may be considered that the tap line of the transformer 500 comprises a primary tap line 507 and a secondary tap line 508. The tap line is positioned such that its longitudinal axis is skewed from the longitudinal axis 506 of the reference bar 504 by a tap line angle such that the primary tap line 507 is connected to the middle of the primary winding 502 by a primary tap line via 509, and the secondary tap line 508 is connected to the middle of the secondary winding 503 by a secondary tap line via 509.

If only one tap line is included, the degree of parallelism between the tap line and the longitudinal axis of the reference bar 504 providing an axis of mirror symmetry may be higher. For example, the one tap line may run parallel to the longitudinal axis of the reference bar and thus parallel to the line of mirror symmetry. Thus, the tap line angle would be smaller (and may be zero).

It may be beneficial to include one or more tap lines in a transformer according to an embodiment of the invention. For example, the transformer may be used in a voltage controlled oscillator (VCO), having a gain element in the primary circuit which receives its power supply through a primary centre tap line connected between the centre/middle of the primary winding and the supply voltage. In this example, a secondary circuit may be connected to the terminals S+ 513 and S− 514 of the secondary winding 503. It may be desirable to include a tuning element, such as a differential varactor in this secondary circuit, which can be tuned by applying a voltage to a secondary tap line.

FIG. 5*b* shows a circuit diagram 550 including the transformer of FIG. 5*a* having a primary tap line connected to the primary winding 552 and a secondary tap line 558 connected to the secondary winding 554. The circuit diagram 550 may be suitable for use in circuit simulation. In this example, the primary and secondary tap lines 556, 558 are centre tap lines in that the primary tap line 556 is connected to the centre/middle of the primary winding 552, and the secondary tap 558 is connected to the centre/middle of the secondary winding 554. When the primary and secondary tap lines 556, 558 are connected to the centre/middle of the primary and/or secondary windings 552, 553 respectively, they may be at a virtual radio frequency (RF) ground under differential operation of the transformer. In this example, providing the pins/terminal connections of the primary and secondary tap lines 556, 558 both at the primary and secondary impedance reference points (that is the terminals Pt 516, 517 and St 518, 519 are provided at both sides A and B of the transformer as shown in FIGS. 5*a* and 5*b*) may be advantageous. Such primary and secondary tap lines may be included in addition to the reference bar 504 which acts to provide a low impedance ground return path 560 with conductive bars 505, as shown in FIG. 5*a*.

Generally, the primary and secondary tap lines 507, 508 may be at an RF signal ground level but at different DC voltage levels. In this case the use of decoupling capacitors may be advantageous to improve overall circuit performance. Such decoupling capacitors may either be added externally in the primary or secondary circuit, or may be integrated into a transformer component according to an embodiment of the invention for better performance.

FIG. 5*c* shows a transformer according to another embodiment of the invention. The transformer of FIG. 5*c* is similar to that of FIG. 5*a*. Features of FIG. 5*c* are labelled with reference numbers in the 580 series which correspond with features of FIG. 5*a* in the 500 series.

In contrast to FIG. 5*a*, only a portion of the primary and secondary tap lines 587, 588 are skewed from the longitudinal axis of the reference bar 584. The portions of the tap lines 587, 588 that provide the terminals Pt, St are substantially parallel to the longitudinal axis of the reference bar 584. That is, the portions of the tap lines 587, 588 at the extremities of the transformer are substantially parallel to the longitudinal axis of the reference bar 584. In this way, two bends can be provided in each of the tap lines 587, 588. The bends may have a 45 degree angle relative to the longitudinal axis of the reference bar 584.

FIG. 6*a* shows an example transformer 600 according to an embodiment of the invention which may behave as an isolation transformer having an integrated decoupling capacitor. The transformer 600 has a primary winding 602, a secondary winding 603 and a ground shield layer 605 that is similar to the one described above with reference to FIG. 4.

The isolation transformer provides galvanic isolation between the primary and secondary windings 602, 603. The attached secondary circuit is assumed to operate at a supply voltage Vsup. The decoupling capacitor functionality may be obtained by alternating connections between the closely spaced shield bars of the ground shield 605 to i) ground 610; and ii) supply rails Vsup 612. A first set of alternating shield bars 620 of the ground shield 605 are connected to ground 610, and a second set of alternating shield bars 630 of the ground shield 605 are connected to Vsup 612. It is not necessary to include tap lines in the example of FIG. 6*a*, since one end of the primary winding 602 is connected to ground 610, and one end of the secondary winding 603 is connected to the supply voltage Vsup 612. By alternating the connections of the closely spaced shield bars of the ground shield 605 to the ground 610 and the supply rails Vsup 612, the fringe decoupling capacitor functionality typically required in applications requiring isolation transformers is obtained. The fingers/strips of the ground shield 605 in this example are small and closely spaced, and therefore can behave as a fringe capacitor.

FIG. 6*b* shows a circuit diagram of the example isolation transformer 650 shown in FIG. 6*a* with primary and secondary windings P 602, S 603 located between a primary circuit and a secondary circuit. The isolation transformer isolates the secondary circuit which operates at a voltage Vsup from the primary circuit. The decoupling capacitor functionality provided by the ground shield of the transformer in FIG. 6*a* is shown in FIG. 6*b* as the capacitor 640.

Example transformers as disclosed herein may comprise primary and secondary windings in a 1:1 ratio. The transformer may comprise a plurality of primary windings and/or a plurality of secondary windings. Other example transformers which are also embodiments of the invention may be multi-turn transformers having multiple primary and/or multiple secondary windings, which may or may not be in a 1:1 ratio of primary turns to secondary turns. The extension of the disclosed 1:1 winding ratio transformers to multi-turn transformers is straightforward for those skilled in the art. This extension can be performed by employing (nested) spirals for the example of FIG. 6*a* or 6*b* or by employing nested turns if there is a need to add connections to the centre of the primary or secondary windings.

FIG. 7 shows an example of a multi-turn transformer with 5 primary windings P and 2 secondary windings S, all fabricated in the same metal layer (winding layer). To interconnect these windings, underpasses/connections that are known to those skilled in the art can be provided in a second lower metal layer. The second lower metal layer is lower (closer to the substrate) than the winding layer comprising the windings. A useful interconnection algorithm for determining the relative locations of turns of the primary and secondary windings is described below. This algorithm may be used for automatic scalable layout generation.

Firstly, the algorithm determines which winding type requires the largest number of turns. In the example of a transformer requiring five primary turns and two secondary turns, the primary winding has the largest number of turns. Then the algorithm selects the outermost winding to be of the type which requires the largest number of turns; in this example, the outermost winding will be a primary winding. Then, alternate winding types are allocated by the algorithm moving from the outermost winding towards the centre of the windings. When it is no longer possible to alternate winding types, the remaining innermost windings are all allocated as the same type. For the example of five primary and two secondary windings shown in FIG. 7, the application of this algorithm leads to the placement outermost of a primary winding, followed by a secondary winding, primary winding, and secondary winding. Since both secondary windings have been used, and three primary windings remain, these remaining primary windings are added moving towards the centre of the windings, giving a winding scheme which may be denoted as PSPSPPP (P for primary winding, S for secondary winding) form the outside to the inside.

Alternating the winding types in this way results in a good inductive coupling between the primary and secondary windings, and thus a high transformer performance.

In an IC process, typically there are 5-6, and up to around 10, metal layers. At the bottom typically thin local interconnect layers are included. At the top, typically one or more thicker layers are included to carry larger signals and more power, over longer distances than signals in the thinner lower layers. A thicker top layer, having a lower resistivity, is well suited for fabricating inductors and transformers. Therefore, the windings shown in FIG. 7 are typically in the top layer and the crossings as shown in FIG. 7 for connecting the windings are typically provided in lower layers.

Combinations of the features described herein may provide very useful components. In electronic circuits it is often desirable to convert single ended signals into differential signals, and vice versa. Components created for this task are usually referred to as baluns (from balanced/unbalanced). One way to realise such a balun component is through the use of a transformer according to an embodiment of the invention.

FIGS. 8*a* and 8*b* show an example of a transformer 800 according to an embodiment of the invention, which may be used as a wide band balun. FIG. 8*a* shows a schematic circuit diagram of the transformer 800. FIG. 8*b* shows a schematic layout of the transformer 800.

The transformer 800 has a primary winding configured to process a single ended (SE) signal at a first winding terminal 80 with reference to a second winding terminal 82 that is connected to ground. The first terminal 80 of the primary winding is connected to receive a signal voltage. The resulting signal current in the primary winding induces a signal voltage in a secondary winding. The secondary winding is configured to provide differential (Dif.) signal voltages at first and second winding terminals 88, 89 with reference to a centre tap 84 on the second winding, which is connected to ground. In this way, the voltages at the two secondary terminals are equal in magnitude, but with opposite sign, and therefore the single ended input signal from the primary winding is transformed into a differential output signal at the secondary winding.

As shown in FIG. 8*b*, the transformer 800 includes a reference bar 86 that is similar to the reference bars that are described above. The second terminal 82 of the primary winding is connected to the reference bar 86; and the centre tap 84 on the secondary winding is also connected to the reference bar 86. As can be seen in FIG. 8*b*, the common connections to ground 82, 84 for the primary and secondary windings are achieved by connection to the reference bar 86. Thus the inclusion of a central internal reference bar 86 allows for a transformer to easily be used as a balun.

Further, it can be desirable to reduce or minimise the common mode signal and increase or maximise the differential signal. By locating the connections to ground 82, 84 of the primary and secondary windings as close together as possible, which may be conveniently achieved by connecting to ground by the reference bar 86, the common mode signal can be sufficiently reduced or minimised.

For a further discussion of the behaviour of the transformer/balun 800 it is beneficial to introduce differential (d) and common mode (c) currents (I) and voltages (V) defined by:

$$V_d=V_1-V_2\ I_d=(I_1-I_2)/2$$

$$V_c=(V_1+V_2)/2\ I_c=I_1+I_2$$

where the indices 1 and 2 refer to the two connections (pins) of the either the primary or the secondary windings. In the balun application of FIGS. 8*a* and 8*b*, $V_2=0$ for the primary winding. This implies that the differential and common mode voltages applied to the primary winding will be $V_d=V_1$ and $V_c=V_1/2$, respectively. To fully analyze the behaviour of the transformer 800 in the balun application the transfer of both the differential as well as of the common mode currents should be considered.

Apart from the desired inductive coupling between the primary and secondary windings there is also an undesired capacitive coupling. The desired inductive coupling transfers differential current, whereas the undesired capacitive coupling transfers common mode current. The inductive and capacitive couplings are closely related. Reducing the separation between the primary and the secondary windings increases both couplings, while increasing the separation decreases both couplings. A high inductive coupling is required for efficient power transfer from the primary to the secondary windings. In the balun application of FIGS. 8*a* and 8*b* the inductive coupling provides the desired differential signal at the output (that is, the two output voltages at the two secondary terminals have a 180 degrees phase difference). In the same balun application of FIGS. 8*a* and 8*b* the capacitive coupling provides an undesired common mode signal at the output (that is, the two output voltages at the two secondary terminals have 0 degrees phase difference).

To reduce the common mode signal at the output, the secondary winding has its centre tap 84 connected to ground by connection to the reference bar 86. As a result the behaviour of the balun will be satisfactory over a wide frequency range. However at higher frequencies, where the inductive behaviour of the transformer 800 will dominate the resistive behaviour and the signal transmission will be at its best, it can be important that the common mode current, which is coupled capacitively in the secondary winding, sees a low impedance return path from the centre of the secondary winding to the circuit ground. To achieve this, it may not be feasible to simply put a large metal ground plate below the transformer 800, since this will affect the magnetic field in the circuit considerably. However, the reference bar 86 of an embodiment of the invention as disclosed above can be extremely well suited for providing a connection from the centre of the secondary winding 84 to the circuit ground.

FIGS. 9*a* and 9*b* show an example of a transformer 900 according to an embodiment of the invention, which may be used as a narrow band balun. FIG. 9*a* shows a schematic circuit diagram of the transformer 900. FIG. 9*b* shows a schematic layout of the transformer 900.

The transformer 900 has a primary winding configured to process a single ended (SE) signal at a first winding terminal 90 with reference to ground; a second primary winding terminal 92 of the transformer 900 is unconnected and therefore is left floating. The first terminal 90 of the primary winding is connected to receive a signal voltage. A signal current in the primary winding induces a signal voltage in a secondary winding. The coupling between the primary winding and the secondary winding is at its optimum at the self-resonance frequency of the transformer 900. The secondary winding is configured to provide differential (Dif.) signal voltages at first and second winding terminals 98, 99 with reference to a centre tap 94 on the second winding, which is connected to ground.

As shown in FIG. 9*b*, the transformer 900 has a reference bar 96 that is similar to the reference bars that are described above. The connection to ground for the centre tap 94 on the secondary winding is achieved by connection to the reference bar 96. Also, the ground reference at the primary side of the transformer is provided by the reference bar 96. Thus the inclusion of a central internal reference (to ground) bar 96 allows for a transformer to easily be used as a balun.

In the balun application of FIGS. 9*a* and 9*b*, $I_2=0$ for the primary winding. This implies that the current $I_1$ applied to the primary winding will need to return through another path. The reference bar 96 according to this embodiment of the invention can be extremely well suited to provide an integrated ground return path for the current $I_1$ applied to the primary winding.

An aim of one or more embodiments of the invention is to provide a well defined integrated low impedance return path for common mode currents, without adversely affecting the transformer performance in general, and particularly when the transformer is used as a balun.

FIG. 10 shows a mirror symmetric transformer 1000 with reference bar 1004 providing an integrated common mode current return path. The transformer 1000 is fabricated on an isolating or a semiconductor substrate 1001. When the substrate is a silicon substrate it should have a sufficiently high resistivity that the magnetic field of the transformer cannot induce significant currents in this substrate. A substrate resistivity of 10 $\Omega cm^{-1}$ is usually sufficient. The transformer 1000 has at least one primary winding 1002 and at least one secondary winding 1003. The primary winding 1002 has a first primary terminal P+ 1011 and a second primary terminal 1014. In this example the second primary terminal 1014 is connected to ground. The secondary winding 1003 has a first secondary terminal S− 1013 and a second secondary terminal 1012.

Furthermore the symmetric transformer 1000 has a patterned ground shield 1005, for example as described earlier in relation to FIG. 4.

When the transformer 1000 is used as a balun, the secondary winding 1003 may need a secondary tap connection 'X' 1010 connected to the centre/middle of the secondary winding 1003. At the central secondary tap connection 1010 the centre of the secondary winding 1003 is connected to the reference bar 1004 which provides a common mode return path. This common mode return path is formed by an electrically conductive track (the reference bar 1004), located at and following the axis of mirror symmetry 1006.

The conductive reference bar 1004 additionally ensures that a ground pin/terminal is available both in the vicinity of the two primary pins/terminals P+ 1011 and P− 1014 (P− 1014 is connected to ground in FIG. 10) as well as in the vicinity of the secondary pins/terminals S+ 1012 and S− 1013. As illustrated in FIG. 10, in the balun application one of the primary pins P− 1014 is connected to the ground pin provided by the reference bar 1004 in order to comply with the scheme shown in FIGS. 8*a* and 8*b*. In the wide band balun application it is also desirable to connect the conductive ground shield bars 1005 to the reference bar 1004 in order to reduce the capacitive coupling of common mode signals from the primary to the secondary winding(s) 1002, 1003.

There may be several design choices available for building a transformer according to an embodiment of the invention.

Firstly, in a stacked transformer, the desired inductive coupling can be obtained by using the same width and diameter for the primary and secondary windings 1002, 1003 and realising them in different metal (winding) layers. Alternatively, in a lateral transformer the desired inductive coupling can be obtained by using different diameters for the primary and secondary windings 1002, 1003 and realising them in the same metal (winding) layers. Then the mutual inductance can be increased by increasing the number of primary and secondary windings 1002, 1003. Since the winding tracks 1002, 1003 have to be able to cross each other in order that the different primary and secondary windings 1002, 1003 can be connected in series, at least two metal (winding) layers are required to ensure that the desired connections between the transformer windings 1002, 1003 can be made. When only two metal (winding) layers with sufficient thickness for making high performance transformers are available, the use of stacked layouts is restricted to symmetrical designs having equal numbers of primary and secondary turns, which are capable of providing unity impedance transformation ratios. The lateral architecture is more flexible in this respect and enables transformers with different turn ratios to be realised, which can combine balun functionality with impedance transformation functionality using only two metal layers.

An integrated transformer according to this disclosure may be built in a standard IC processing flow, where, after the creation of transistors, diodes and resistors in the silicon substrate, a number of interconnect metal layers are added. Typically the ground shield 1005 is made by patterning a polysilicon or first metal (ground shield) interconnect layer. The conductive reference bar 1004 can be made in the same layer as the ground shield, or alternatively in a subsequent metal (reference bar) layer. Then the primary and secondary windings 1002, 1003 and their crossings may be realised in a third and a fourth metal layer (winding layers). The different metal layers can be interconnected with vias where necessary. For certain applications where galvanic isolation (at low frequency) between primary windings 1002, secondary windings 1003 and/or a ground shield 1005 is required, it may be desirable to partly implement the conductive reference bar 1004 in up to three different interconnected metal (reference bar) layers: one layer for the ground shield, another layer for the primary windings and a further layer for the secondary windings.

When this is done, the different metal layers used for the conductive reference bar 1004 should be connected with suitable decoupling capacitors at suitable locations such as that shown in FIG. 6*a*. Such locations are preferably inside the transformer, in order to ensure that at the RF operating frequency of the transformer/balun the impedance for the common mode return currents is not too high. When such a decoupling capacitor is integrated with the transformer, it can be located in the winding-free centre of the transformer. To minimise any adverse effect to the magnetic field of the transformer by the presence of a decoupling capacitor, the capacitor should be of the fringe type, which employs the capacitance between closely spaced metal strips in the same metal layer. The strips (fingers) should be closely spaced and narrow in width, and preferably oriented perpendicular, or at least transverse, to the axis of mirror symmetry 1006. The strips/fingers should also be vertically connected by vias and alternatingly connected to the conductive strips of the ground shield 1005. There are various different options for connection, which will be clear for those skilled in the art.

FIG. 11*a* shows a transformer/balun 1100 according to an embodiment of the invention with a reference bar 1104 that provides an integrated return current path. FIG. 11*a* shows a solid line 1111 that represents the desired common mode return current path capacitively coupled from the primary winding 1102 into the secondary winding 1103. FIG. 11*a* also shows a dashed line 1112 that represents the undesired common mode return current path. If the common mode impedance in the secondary winding 1103 and in the conductive reference bar 1104 is too big, then part of the capacitively coupled common mode currents will take the undesired dashed path 1112 and disturb the phase and amplitude balance of the differential output signal at the secondary terminals S.

FIG. 11*b* shows a simplified equivalent circuit for the balun of FIG. 11*a*. A current loop 1111 is shown that represents the common mode current capacitively coupled from the primary winding 1102 into the secondary winding 1103. A common mode current fraction loop 1112 is shown that disturbs the phase and amplitude balance of the differential output signal at the secondary terminals S. To reduce the current fraction 1112 it can be important to reduce the capacitance C and in particular the inductance L1. A reduction of inductance L1 can be achieved by using the reference bar 1104 shown in FIG. 11*a* and described above.

FIG. 12 shows the imbalance measured on three actual transformers each having a centre tap line connected to the outermost winding and having a reference bar. The imbalance is measured as a ratio of the transformation into a common mode signal to the transformation into the desired differential signal. FIG. 12 illustrates the behaviour of a 1×1 transformer with line 1202, a 2×2 transformer with line 1204 and a 3×3 transformer with line 1206.

The transformers were used in a balun application. The three transformers each have an outer diameter of about 250 μm. For the two multi-turn cases (the 2×2 and the 3×3 transformers), the primary and secondary turns are alternated in the radial direction. The imbalance is calculated by dividing the undesired common output signal by the desired differential output signal. An imbalance of less than 0.05 is considered acceptable for most applications, which means that no more than 5% of the signal should be an undesirable common mode signal while at least 95% of the signal should be the desired differential signal). The frequency at which this value of 0.05 is reached is listed as the maximum usable frequency $f_{max}$ in Gigahertz (GHz) in the table below.

| Transformer | C fF | L1 pH | L2 pH | $f_{max}$ GHz |
|---|---|---|---|---|
| 1 × 1 | 121 | 14 | 424 | 44 |
| 2 × 2 | 340 | 12 | 96 | 15 |
| 3 × 3 | 520 | 15 | 225 | 11 |

Also listed in the above table are the common mode equivalent capacitance C (measured in femtoFarads, fF) and inductances L1 and L2 (measured in picoHenries, pH) for the schematic of FIG. 11*b* as extracted from measurements taken around $f_{max}$ on these transformers.

It can be seen that when the number of turns is increased to increase the mutual inductance, the mutual capacitance also increases considerably. This is the main reason for the drop in $f_{max}$ as the number of turns/windings increases. It is further seen that L1 is considerably smaller than L2, which implies that most of the capacitively coupled common mode current will indeed take the desired return path 111 rather than the undesired return path 112.

There are several application areas for one or more transformers according to an embodiment of the invention, each having different requirements. A voltage controlled oscillator (VCO) tank may be realised using a transformer with primary and secondary windings in a 1:1 ratio, with two centre taps providing flexibility for varactor biasing and allowing an improved phase noise performance of the VCO. A high Q-factor of the primary and secondary windings, and a good coupling coefficient may be required.

Interstage matching may be achieved using a transformer with a selectable turn ratio and two centre taps, combining impedance transformation with flexible biasing. A low transformer loss may be again required.

Galvanic isolation may be achieved. Primary and secondary windings can be used at vastly different potentials. This is an attractive option for the input or output of a circuit. A high dielectric breakdown voltage may be required.

An important application of transformers employing a reference bar to provide a conductive ground track as disclosed herein is as an input and output matching balun, that can convert single ended signals to differential signals and vice versa. An input and output matching balun may be realised using a transformer with a selectable turn ratio and a centre tap line at the differential side in order to simultaneously provide: i) impedance transformation; ii) single ended to differential conversion; and iii) bandpass filtering. A low transformer loss may be required.

FIG. 13 shows a circuit diagram of an input and output matching balun. In FIG. 13, a differential amplifier (Amp.) employs two baluns using two transformers, one at the input and one at the output side, each transformer with a reference bar as disclosed herein. The use of a differential amplifier can be attractive to reduce susceptibility to electromagnetic interference, reduce signal loss in the ground return paths and improve linearity.

In relation to improving linearity, when RF signals are amplified, due to the inherently nonlinear characteristic of the transistors used in the two amplifier branches, the output signal will not be an exact replica of the input signal. Particularly at high signal levels, the output signal will likely contain harmonics of the input signal. At the fundamental frequency, the signals amplified in the two amplifier branches will have a 180 degree phase difference. At the second harmonic frequency however, due to the frequency doubling, the signals from the two amplifier branches will be in phase again (0 degrees phase difference).

In general, when the two amplifier branches are equal, all even harmonics will leave the amplifier as common mode signals, which do not pass an ideal output balun, and consequently the balun output will primarily contain odd harmonics. As a result when a high linearity is desired, only the odd harmonics of the branch amplifiers may have to be reduced. Typically differential amplifiers may be designed to have a high common mode rejection ratio (CMRR), in which case the differential amplifier benefits arising from using transformers having reference bars can already be realised with relatively poor baluns. However, in other applications, the linearity requirements can be extremely strict, and the use of a transformer balun incorporating a reference bar according to this disclosure, with the best possible CMRR at the operating frequency and the relevant harmonics, may be advantageous.

In summary, one aim is to provide well defined impedance reference points which can serve as a simulation interface with the circuit in which the transformer will be used. This may be achieved by defining two separate impedance reference points, one for the primary windings at a first side of the transformer and one for the secondary windings at a second different side of the transformer. Furthermore, apart from the usual positive and negative terminals of each transformer winding, each impedance reference point has a local ground terminal provided by the reference bar, against which the voltages and currents of the other primary and secondary winding terminals can be evaluated. A second aim is to provide an integrated low impedance ground return path for common mode currents, without adversely affecting the transformer performance in general.

A connection to ground running outside the area of the primary and secondary windings from an external reference line (as opposed to an internal reference line as described above) would necessarily be longer than an internal ground return line/reference bar. This increased length of the ground line requires more valuable on-chip space which may otherwise be used for, for example, including more transistors on the integrated circuit. Also, an outside ground line is more difficult to model in circuit simulations and leads to higher model inaccuracies (for example, since an outside ground return line would be longer than an internal ground line, it would have a higher resistance which is more difficult to accurately model).

If the ground line is included outside the primary and secondary windings area, then the location of the outside ground line would be less well known than an internal ground line, for example running straight along a mirror symmetric axis through the primary and secondary windings. A less well known/defined location of ground line also would lead to inaccuracies in a circuit model. A more well defined location of ground line, such as that provided by the internal ground line/reference bar according to an embodiment of the invention can allow better account to be taken of effects related to the ground line in the design phase of the circuit.

FIG. 14 shows a cross-sectional view of a transformer 1400 according to an embodiment of the invention. In the embodiment depicted in FIG. 14, the transformer includes one or more winding layers 1402, a reference bar layer 1404, and a substrate 1406. The reference bar layer is located between the one or more winding layers and the substrate.

The invention claimed is:

1. An integrated circuit based transformer, comprising:

a primary winding located in a winding layer, the primary winding having two primary terminals at a first side of the transformer;

a secondary winding located in a winding layer, the secondary winding having two secondary terminals at a second side of the transformer, the first and second sides located at different sides of the transformer;

a reference bar located in a reference bar layer, the reference bar having a primary reference bar terminal at the first side of the transformer, and having a secondary reference bar terminal at the second side of the transformer, wherein the reference bar is configured to provide a direct electrical connection between the first reference bar terminal and the second reference bar terminal, wherein the reference bar is configured to provide a common connection to ground for the primary and second windings, wherein the reference bar is located entirely along a central mirror symmetric axis of the transformer, and wherein each of the primary and secondary windings covers less than one circle; and a tap line located in a tap line layer having a tap line terminal located at a side of the transformer, the tap line providing a connection between the tap line terminal and the primary or secondary winding partway along the winding, wherein the tap line has a longitudinal axis positioned substantially along the longitudinal axis of the reference bar, wherein the tap line comprises a primary tap line and a secondary tap line, and wherein the tap line is positioned such that at least a portion of the longitudinal axis of the tap line is skewed from the longitudinal axis of the reference bar by a tap line angle such that the primary tap line is connected to the middle of the primary winding by a primary tap line via, and the secondary tap line is connected to the middle of the secondary winding by a secondary tap line via.

2. The integrated circuit based transformer of claim 1, wherein the reference bar is located such that the reference bar overlaps the primary and secondary windings.

3. The integrated circuit based transformer of claim 1, wherein the first and second sides are on opposite sides of the transformer.

4. The integrated circuit based transformer of claim 1, further comprising a substrate, wherein the reference bar layer is located between the winding layer or winding layers and the substrate.

5. The integrated circuit based transformer of claim 1, wherein the primary and secondary windings are concentric.

6. The integrated circuit based transformer of claim 1, wherein the transformer is mirror symmetric about an axis oriented along the longitudinal axis of the reference bar.

7. The integrated circuit based transformer of claim 1, wherein the primary winding is in the same winding layer as the secondary winding, the primary winding and secondary winding each having a different winding radius.

8. The integrated circuit based transformer of claim 1, wherein the primary winding is in a primary winding layer and the secondary winding is in a secondary winding layer separate to the primary winding layer.

9. The integrated circuit based transformer of claim 1, further comprising:

a ground shield located in a ground shield layer, the ground shield comprising a series of strips of conducting material.

10. The integrated circuit based transformer of claim 9, wherein the ground shield layer and the reference bar layer are the same layer.

11. The integrated circuit based transformer of claim 9, wherein:

a first terminal of the primary winding is connected to ground;

a first terminal of the secondary winding is connected to a different voltage;

alternate strips of the ground shield are connected to the primary winding; and oppositely alternate strips of the ground shield are connected to the secondary winding.

12. The integrated circuit based transformer of claim 1, wherein:

a first terminal of the primary winding is connected to the reference bar; and the secondary winding is connected partway along its winding to the reference bar.

13. The integrated circuit based transformer of claim 1, wherein:

a first terminal of the primary winding is unconnected; and the secondary winding is connected partway along its winding to the reference bar.

14. The integrated circuit based transformer of claim 1, wherein the transformer is mirror symmetric about the central mirror symmetric axis.

15. The integrated circuit based transformer of claim 1, wherein the two primary terminals, the two secondary terminals, the primary reference bar terminal and the secondary reference bar terminal are provided at a boundary of the transformer.

16. The integrated circuit based transformer of claim 1, wherein the primary reference bar terminal is located between the two primary terminals, and wherein the secondary reference bar terminal is located between the two secondary terminals.

* * * * *